US005363549A

United States Patent [19]

Hecker

[11] Patent Number: 5,363,549

[45] Date of Patent: Nov. 15, 1994

[54] CABLE LAMINATING AND TERMINATING SYSTEM

[75] Inventor: Jack D. Hecker, Duncanville, Tex.

[73] Assignee: E. D. Design Manufacturing, Dallas, Tex.

[21] Appl. No.: 99,607

[22] Filed: Jul. 30, 1993

[51] Int. Cl.[5] ..... H01R 43/04

[52] U.S. Cl. ..... 29/742; 29/749; 29/753

[58] Field of Search ..... 29/749, 742, 753, 759, 29/861

[56] References Cited

U.S. PATENT DOCUMENTS 4,148,130 4/1979 Stauffer et al. ..... 29/749 X
4,344,225 8/1982 Johnson, Jr. et al. ..... 29/749 X
4,570,326 2/1986 Meyer et al. ..... 29/749 X
4,885,838 12/1989 Ruecker et al. ..... 29/749 X
5,138,762 8/1992 LeBan et al. ..... 29/749

*Primary Examiner*—Carl E. Hall
*Attorney, Agent, or Firm*—John E. Vandigriff

[57] ABSTRACT

An apparatus for making a cable utilizing round cable with a plurality of conductors, and attaching ribbon cable connectors to portions of the conductors that have been arranged in a flat array of conductors includes a lacing bar on which the cable and connectors are mounted, and two pressing stations, the first of which is used to lamination the flat array of conductors together in the flat array, and a pressing station that presses the conductors into the contacts of the connector. The lacing bar includes comb blocks and carriers into which the connectors are positioned under the flat array of conductors.

15 Claims, 9 Drawing Sheets

CABLE LAMINATING AND TERMINATING SYSTEM

FIELD OF THE INVENTION

This invention relates to an apparatus and system for making flat cables from bundled wires and the terminations therefore, and more particularly to an apparatus and method for separating and placing wires over a connector for laminating the wires in spaced relationship with each other over connector terminals.

BACKGROUND OF THE INVENTION

The separation of bundle wires into flat ribbon cables is accomplished by placing individual wires into a comb block in which a plurality of parallel grooves are formed. The wires are placed in the grooves to hold them in place while the wires are laminated together placing a metal foil or plastic strip over the wires and applying heat and pressure. Apparatus with grooved blocks for laminating wires are described in U.S. Pat. Nos. 4,885,838 and 5,005,611.

The separated wires are attached to terminal blocks or connectors by pressing the wires into a "Y" shaped terminal connector, the connector cutting through the insulating material on the wire and making contact with the conductor inside the insulation. The grooves in the comb blocks are spaced so that one wire in a groove overlays a connector contact and is pressed into the connector, connecting the wires with the contacts on the connector. Apparatus for pressing wires into contacts as above describes is shown in U.S. Pat. No. 4,908,941.

SUMMARY OF THE INVENTION

The invention is to an apparatus and method for manufacturing round cables utilizing press fit connectors normally used with flat cables. The apparatus has pressing stations, one of which is used to apply a lamination to parallel placed wires for holding them in a flat parallel configuration. A second station is used to press the laminated wires into electrical contact with the contacts in the connector.

A lacing bar with at least two connector stations is used to hold the cable in place during the lamination and attachment of the connector. On the lacing bar, and associated with each connector is a comb block and a comb block carrier. A connector is placed in the carrier. The carrier, when placed in the comb block accurately aligns the connector contacts with parallel grooves and the wires placed therein.

The comb block, in applications where small wires are used, accepts two wires in each groove. The wires are then twisted over the contact so that each of the two wires is placed over a contact.

The lacing bar is moved under the pressing stations until a sensor indicates that the contact is under the pressing station, and in position to laminate the wires or press the connector parts together and press the wire into electrical contact with the contacts in the connector. The lamination press station also includes a guide that centers the connector under the lamination station in the event that the connector is not exactly placed under the lamination press in response to the sensor.

The apparatus includes various safety features including an interlock shield that is lowered to activate circuitry required to activate the pressing stations. This ensures that an operator does not have a hand under a press during pressing operations.

Features of the invention include a housing including at first and second pressing stations; a platform under the housing and pressing stations; a lacing bar, including a plurality of comb blocks for holding conductors, movable on said platform for holding a cable, and connectors that are be attached to the cable; and sensors on said platform for indicating when a connector is under a pressing station.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
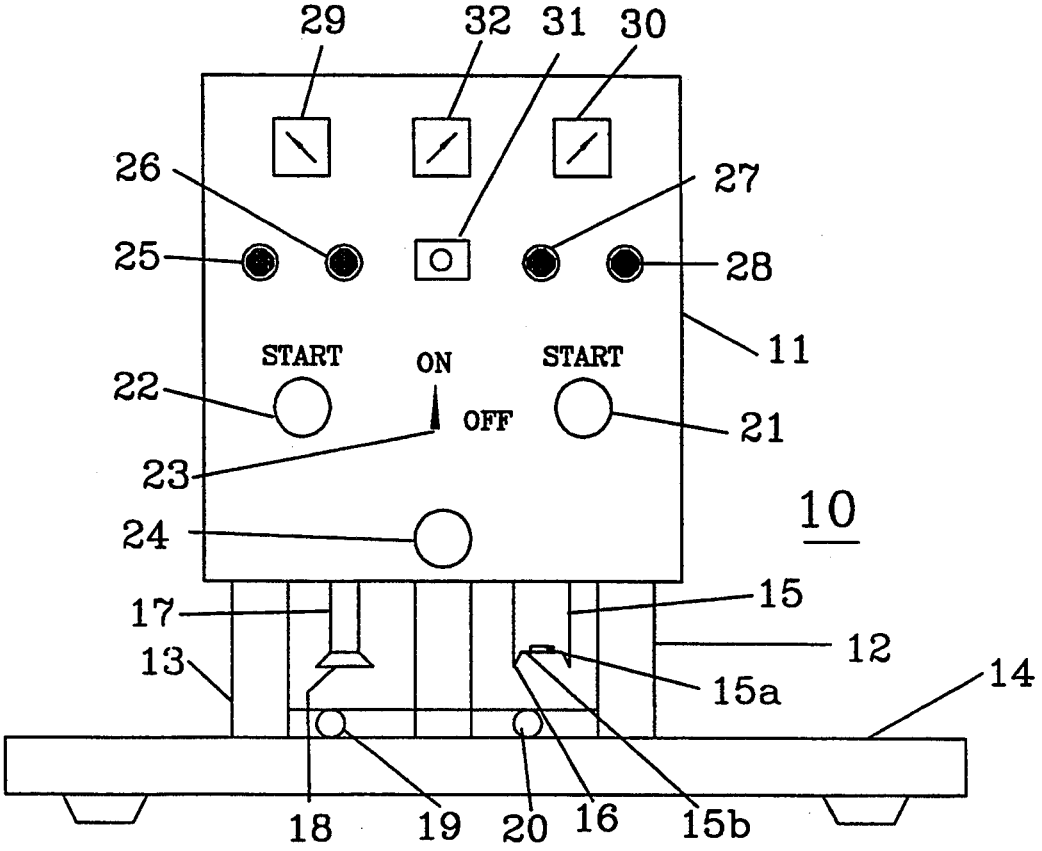
FIG. 1 is a front view of the lamination and terminating apparatus.

The apparatus of the invention is shown, in part, in FIG. 1. Apparatus 10 includes a housing 11 that houses the pneumatic and electrical control for laminating and pressing wires of a cable into contacts in a connector. The controls include, for example ON-OFF switch 23, temperature indicator 32, air pressure gauges 29 and 30, timer control 31 and start switches 21 and 22 for each of the lamination and contact pressing stations. Indicator lights 25–28 indicate the ready/not ready for each of the hydraulic press stations.

Figure 2:
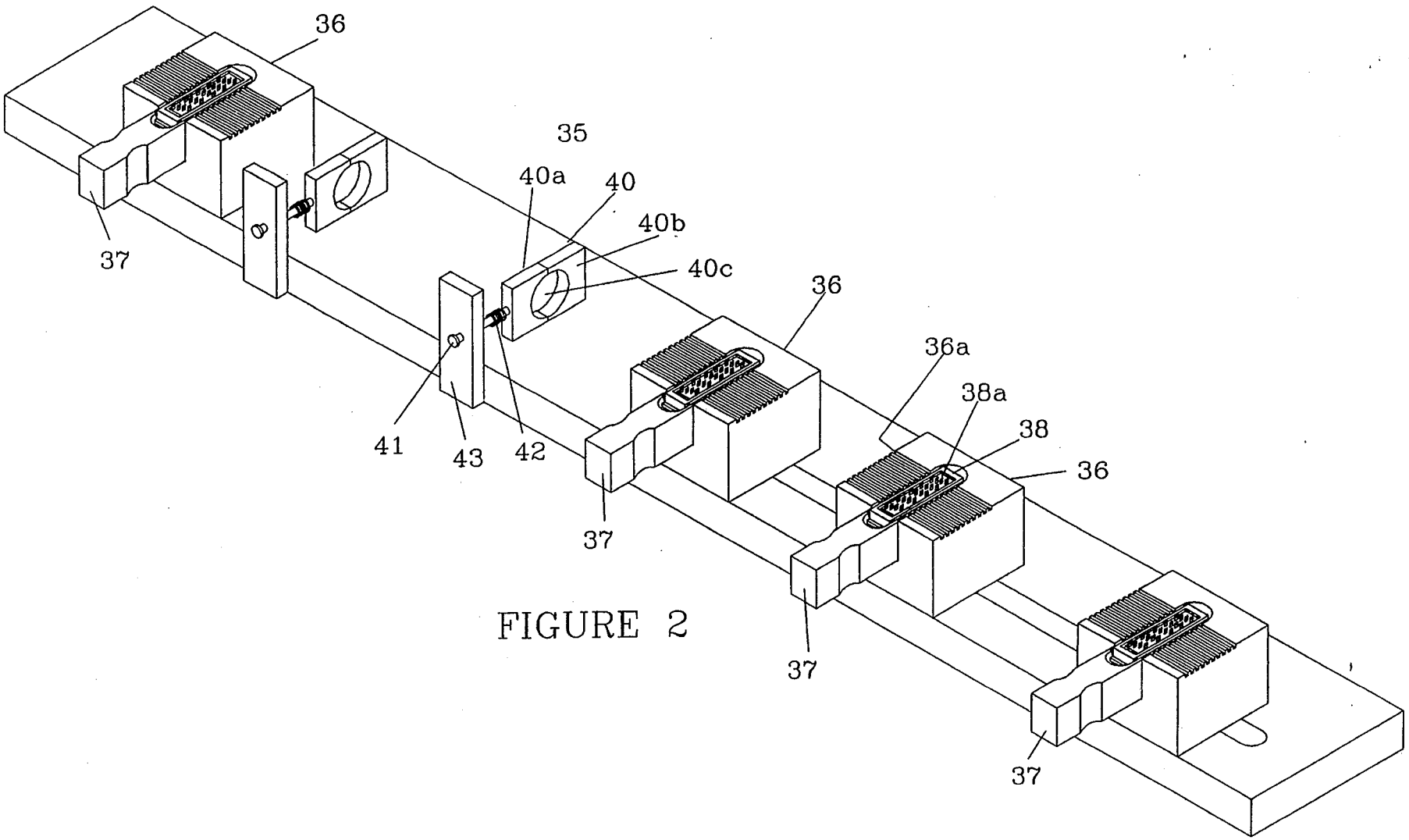
FIG. 2 illustrates the lacing bar and comb blocks.

FIG. 2 illustrates a lacing bar on which a cable is formed prior to laminating and pressing the wires into contacts on the connector. Lacing bar 35 has provisions for mounting a plurality of comb blocks 36. Comb blocks are adjustably mounted over slot 39. The comb blocks are positioned along slot 39 depending upon the desired spacing of connectors along a cable. Each comb block has a connector carrier 37 mounted therein. Each carrier 37 has a connector 38 positioned in the carrier to align contacts **38*a* with grooves 36*a* in comb block 36**.

Also on lacing bar 35 is a cable clamp 40 for holding the cable in position while the wires of the cable are placed in grooves **36*a*, and to prevent movement of the cable until after lamination and connecting the wires of the cable to the connector contacts. Clamp 40 includes parts 40*a* and 40*b* that hold the cable. Part 40*b* is fixed mounted on top of lacing bar 35. Part 40*a* is attached to shaft 41 held in position by brace 43. To open clamp 40, shaft 41 is pulled outwardly pulling part 40*a* away from part 40 opening the clamp to allow a cable to be placed in opening 40***c*. Spring 42 closes clamp 40 when shaft 41 is released closing the clamp. The structure of clamp 40 is given here as one example of a cable clamp. Any configuration that will hold a cable in a fixed position is suitable. Two clamps are illustrated in FIG. 2. One clamp is acceptable, but two clamps better stabilize cable bundle where the outer jacket is removed to fan the wires out into a flat cable.

Figure 4:
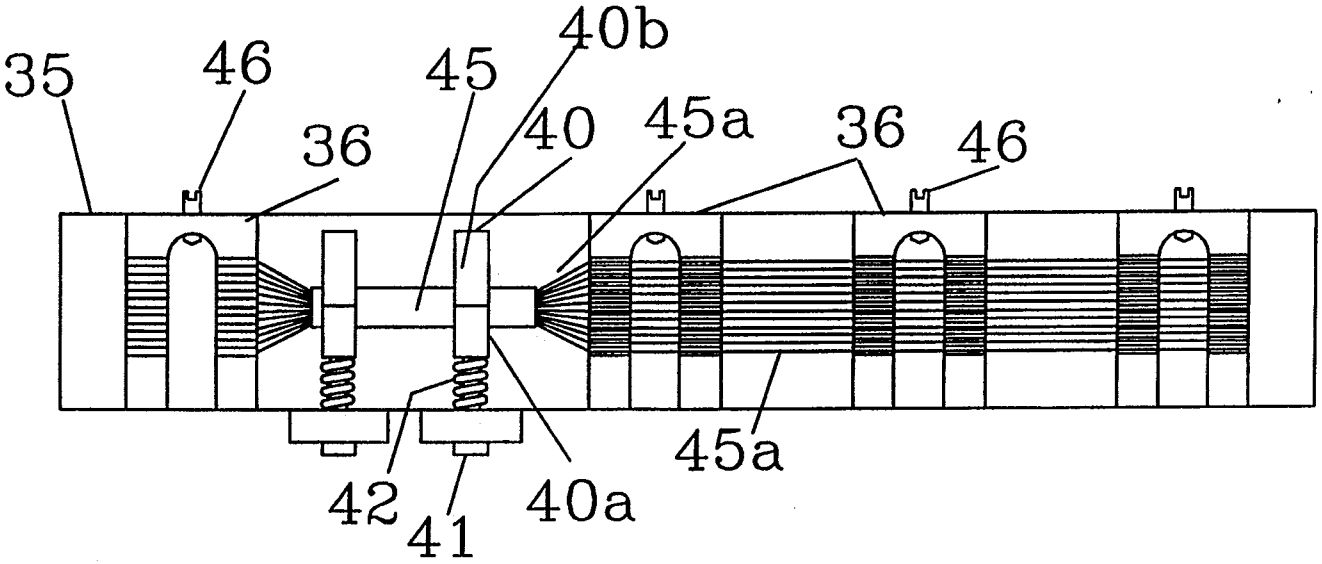
FIG. 4 is a top view of the lacing bar.
Figure 3:
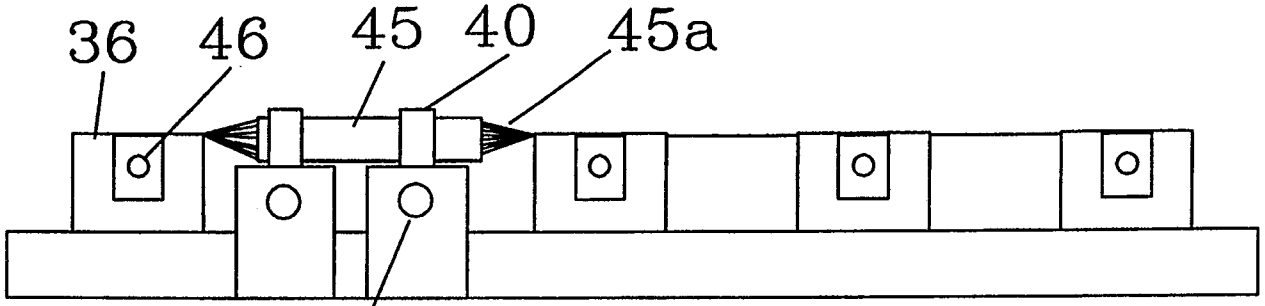
FIG. 3 is a front view of the lacing bar.

FIG. 3 is a front view of the lacing bar with a cable 45 clamped in position. FIG. 4 is a top view. Cable 45 is clamped in clamps 40. The cable insulation has been removed from the cable at points adjacent to the clamps to expose the plurality of wires 45*a*. Wires 45*a* are fanned out and placed into grooves 36*a* in comb block 36. FIG. 3 and 4 do not illustrate the connecter and connector carrier.

Figure 5:
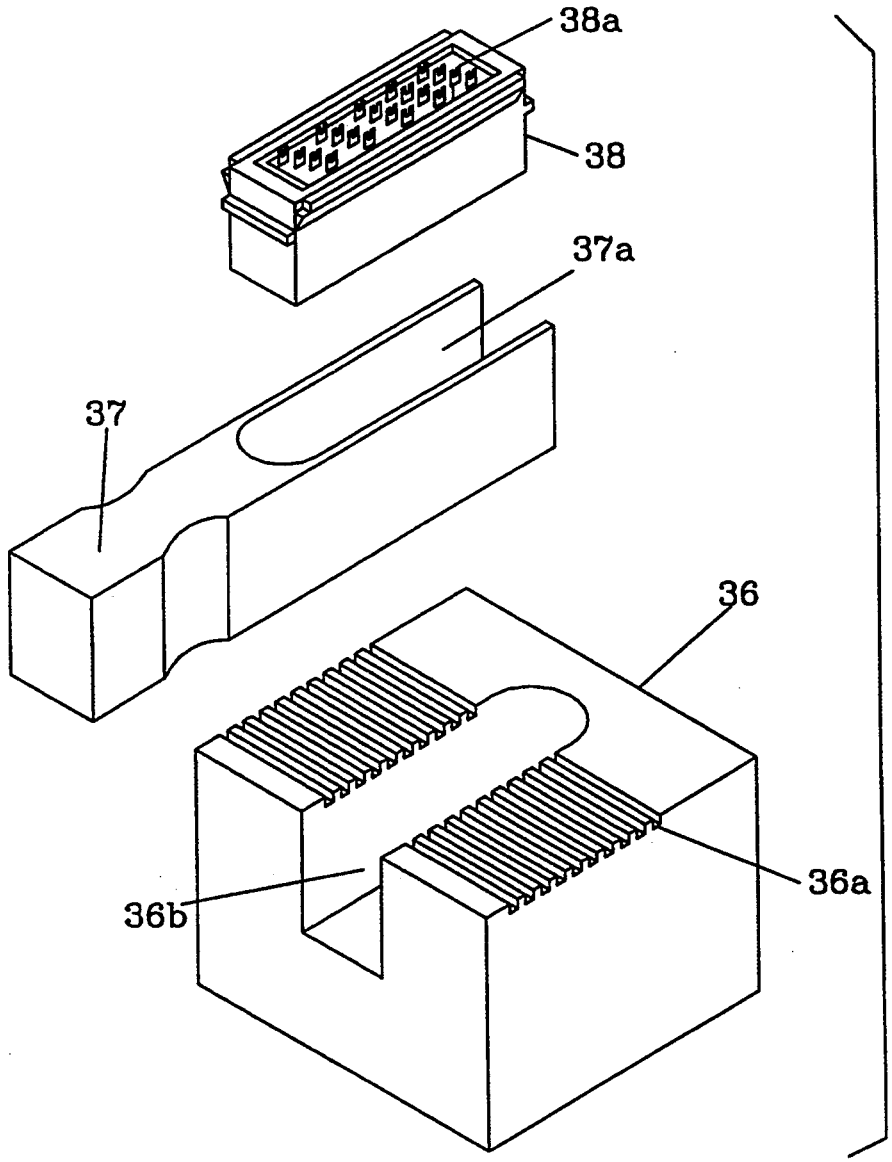
FIG. 5 is an exploded view of a comb block carrier and connector.
Figure 6:
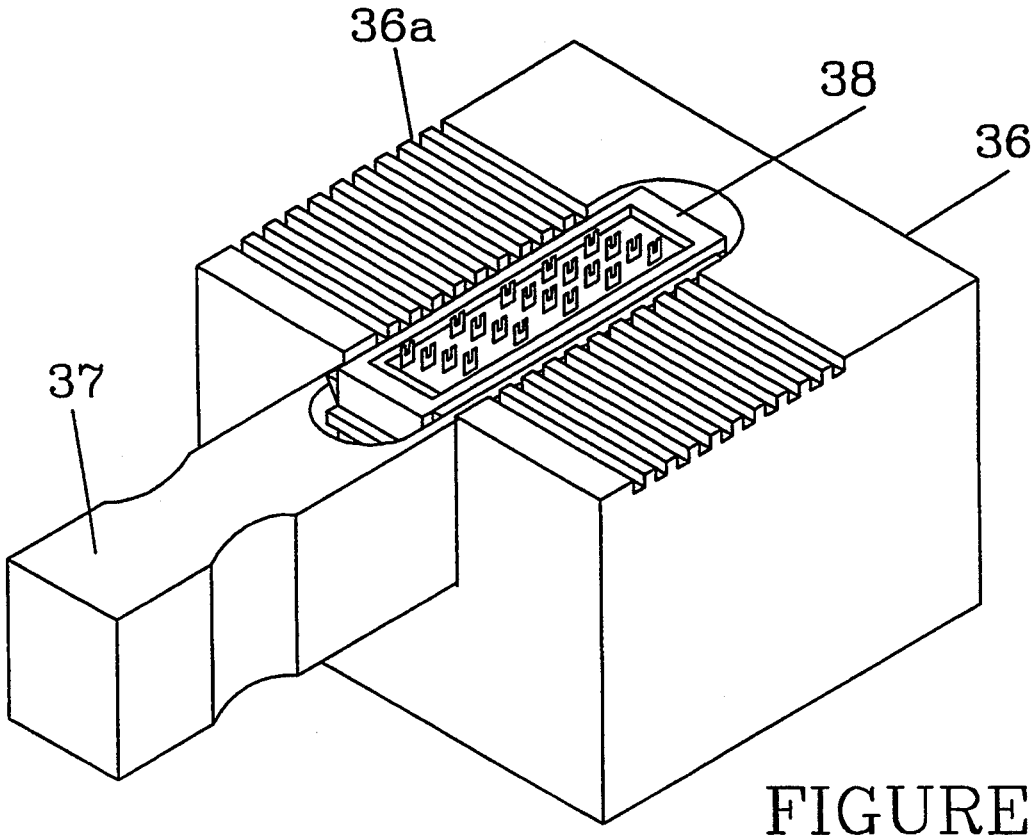
FIG. 6 is an assembled view of the comb block, carrier and connector.

FIG. 5 is an exploded view of the comb block 36, connector carrier 37 and connector 38. The carrier and connector are assembled together as illustrated in FIG. 6. The connector 38 is placed in opening 37*a* in carrier 37, then the carrier and connector are placed into comb block 36. Since it is necessary to have the contacts 38*a* of connector 38 aligned with the wires 45*a* in grooves 36*a*, the carrier 37 and connector 38 therein have to be properly positioned in slot 36*b* in comb block 36. To provide proper placement of the connector, each carrier is designed for a specific connector, and an adjustment screw 46, FIGS. 3 and 4, is set to insure proper placement of connector 38.

The number and size of the wires in the cable, in part, determine the number of grooves required in the comb block. As an example, a comb block may have grooves that are spaced apart on 0.050 inch centers. In this example, a single wire may be placed in each groove and the wire overlays a contact on the connector. However, in some cables, a 0.050 inch spacing with one wire per groove would limit the number of wires that can be connected to a connector.

Figure 7:
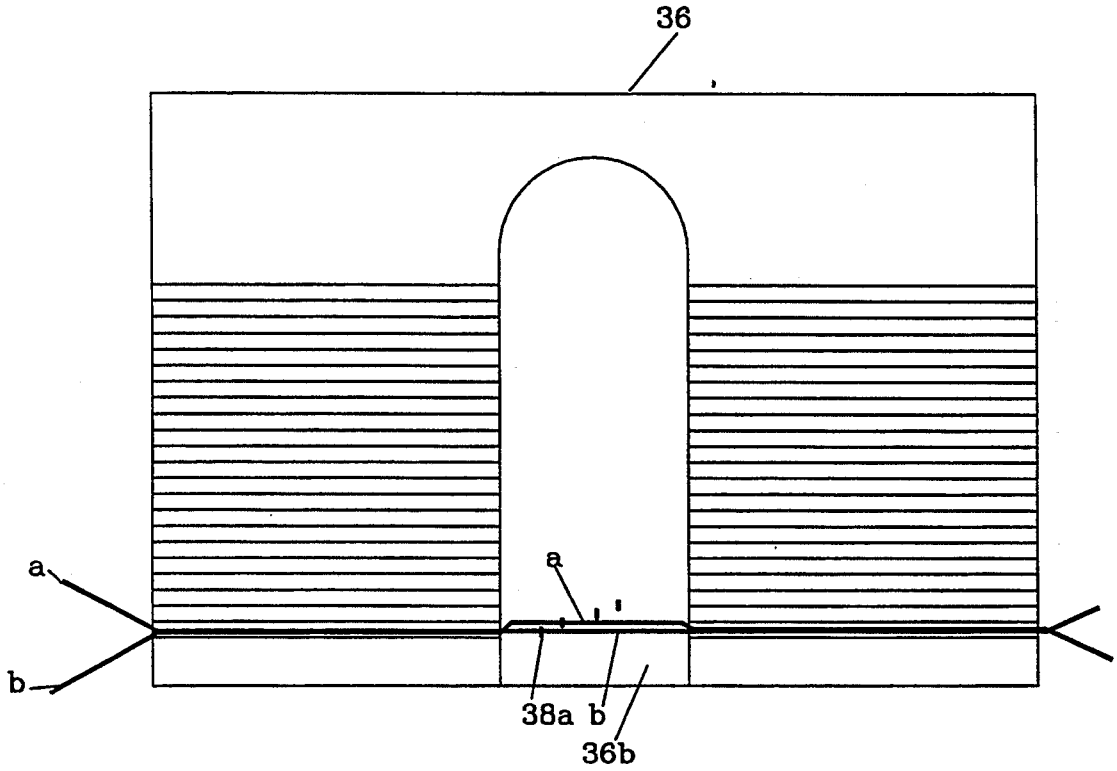
FIG. 7 illustrates the use of a single groove for two wires.

A specific feature of the invention is that wires may be used with a comb block with 0.050 inch spaced grooves to place the wires over contacts that have a 0.025 spacing. Specifically, two wires may be placed in a single groove and then twisted to place one of the wires over a first contact in line with a groove in the comb block, and placing the other wire over a connector contact displace laterally from the first contact by 0.025 inch. This feature is illustrated in FIG. 7. Wires a and b are placed in groove 36*a* and then twisted to place the wires side-by-side above carrier opening 36*b*. Since the contacts 38*a* are staggered, as illustrated in FIG. 5 and 6, the contacts can have closer spacing and underlie wires a and b where they have been twisted to be placed in a side-by-side position.

Figure 8:
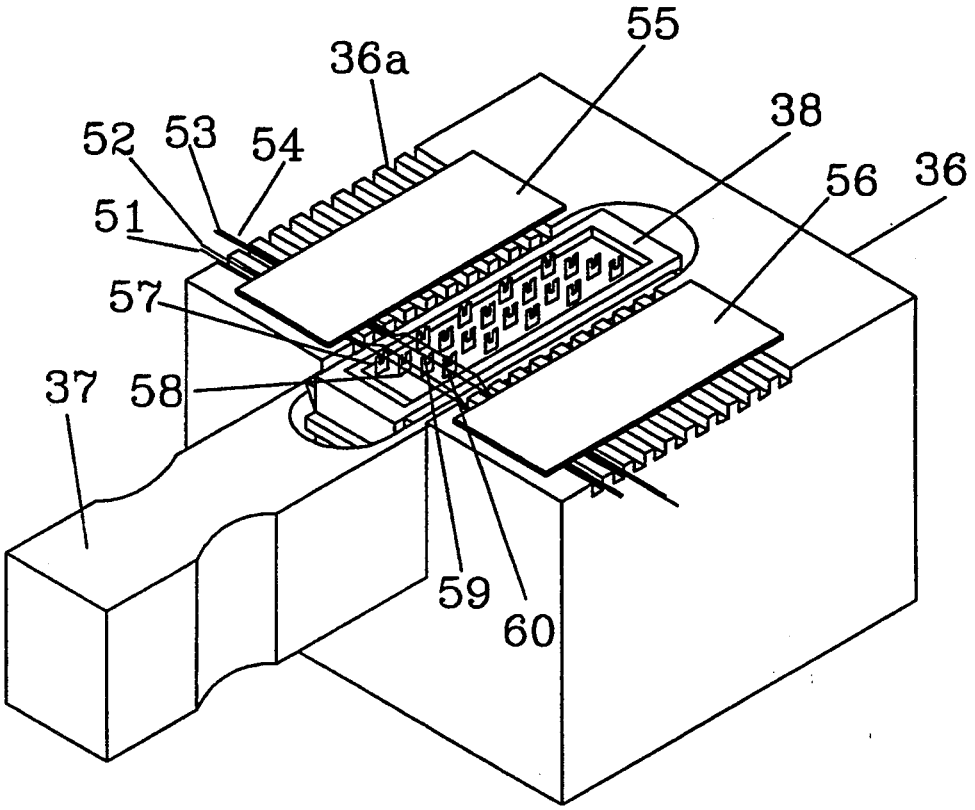
FIG. 8 shows two conductor is a single slot and folded to connect to two connector contacts.

FIG. 8 shows comb block 36 with cable conductors 51–52 in a common groove 36*a*. Conductors 51,52 are folded to lay side-by side and extend through contacts 57 and 58, respectively. Similarly, conductors 53–54 are in a common grove 36*a* and then are folded to overlay contacts 59 and 60, respectively. After making contact with contacts 57 and 58, conductors are again routed through a common groove. Laminations 55 and 56 overlay the conductor and hold them in a flat array, and provides a strain relief area on both sides of the connector to prevent damage to any one individual wire.

Figure 9:
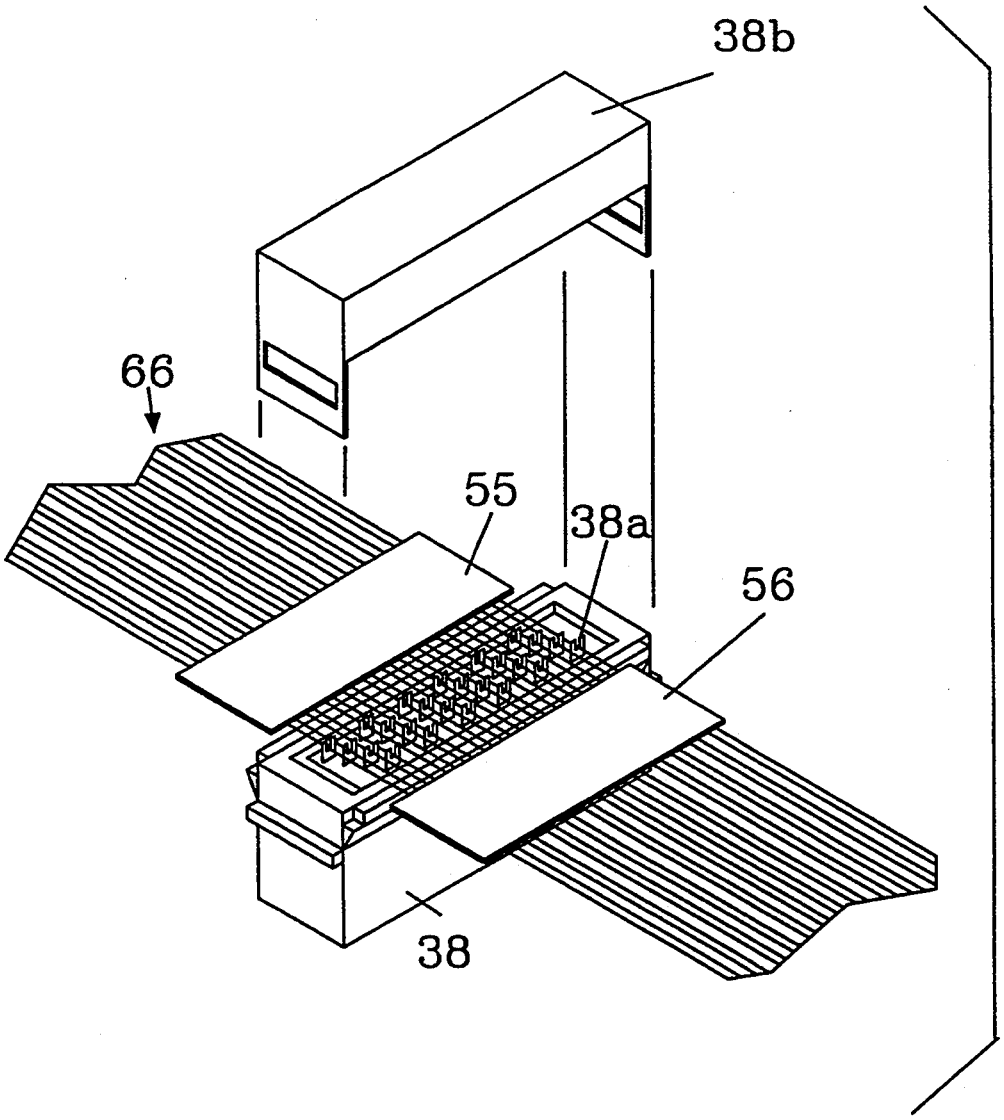
FIG. 9 shows laminated conductors on a connector and the connector top part.

FIG. 9 shows the bottom part of connector 38 with the conductors wires 66 laminated to lamination strips 55 and 56 on each side of connector 38, and with each wire connected to one contact. Connector top part 38*b* is pressed down (pressing station 17, FIG. 1) upon the bottom part, and to force a conductor wire 66 into electrical contact with a contact 38*a*.

In manufacturing a cable, a multiple conductor cable is cut a length representative of the approximate length of the finished cable. The outer jacket is removed where the conductors are to be placed in a comb block. The cable is then clamped in placed. FIG. 4 shows a cable with four connectors, and a short section of the original cable at 45. However, if the cable is to be longer than illustrated, the cable art 45 can be looped between the two clamps 40 to provide a longer cable length between first two conductors at the left end of the cable. After the cable is clamped in clamps 40, the individual conductors of the cable are placed in comb blocks 36 over connector contacts 38*a* (FIG. 2). While the cable jacket is shown to be removed between all but two of the connectors, the jacket may remain in place if desired, particularly where the distance between connectors permits the cable jacket to remain in place and still leave sufficient length to fan the conductors into a flat ribbon at the connector. The cable is ready to have lamination strips adhered over the conductors on each side of the contacts.

Lacing bar 35 with the cable and cable conductors in place is placed on platform 14 (FIG. 1) on apparatus 10. As viewed in FIG. 1, lacing bar 35 is moved from right to left on platform 14 until the first comb block is under the lamination press 15. A sensor 20 detects the presence of the comb block and indicator light 28 is turned-ON indicating that the comb block, cable and connector are properly positioned under pressing station 15. While the comb block is not under pressing station 15, indicator light 27 indicates "not ready". Sensor 20 can be any type of sensor such as an optical or mechanical sensor. For example, a mechanical sensor may be a micro switch that is activated when the comb block activates it as comb block 36 is moved into position.

To ensure proper operation, indicator 30 shows the pressure set to move pressing station 15 downward. Pressing station is activated by, for example, an air cylinder that is moved downward when start switch 21 is pressed. Since pressing station is used to laminate a strip of material to the space wires, heat is used to fuse the laminating material to the insulation on the wires. Gauge 32 shows the temperature at which the pressing shoulders 15*b* are heated. The length of time that the downward pressure is applied in laminating the wires is set by timer 31. In pressing the lamination material onto wire 45*a*, pressing station 15 is lowered by air pressure so that shoulders 16*b* press the lamination material onto the cable wires. A recessed area 15*a* is in the face of pressing station 15 so that no pressure is exerted against the contacts of the connector during lamination.

To further assure that the comb block and connector is centered under the lamination station, centering fingers 16 provide a precise adjustment by extending down on each side of the comb block and moving the comb block and connector under the lamination station. This ensures that shoulders 15*b* do not press against the contacts on the connector.

Figure 10:
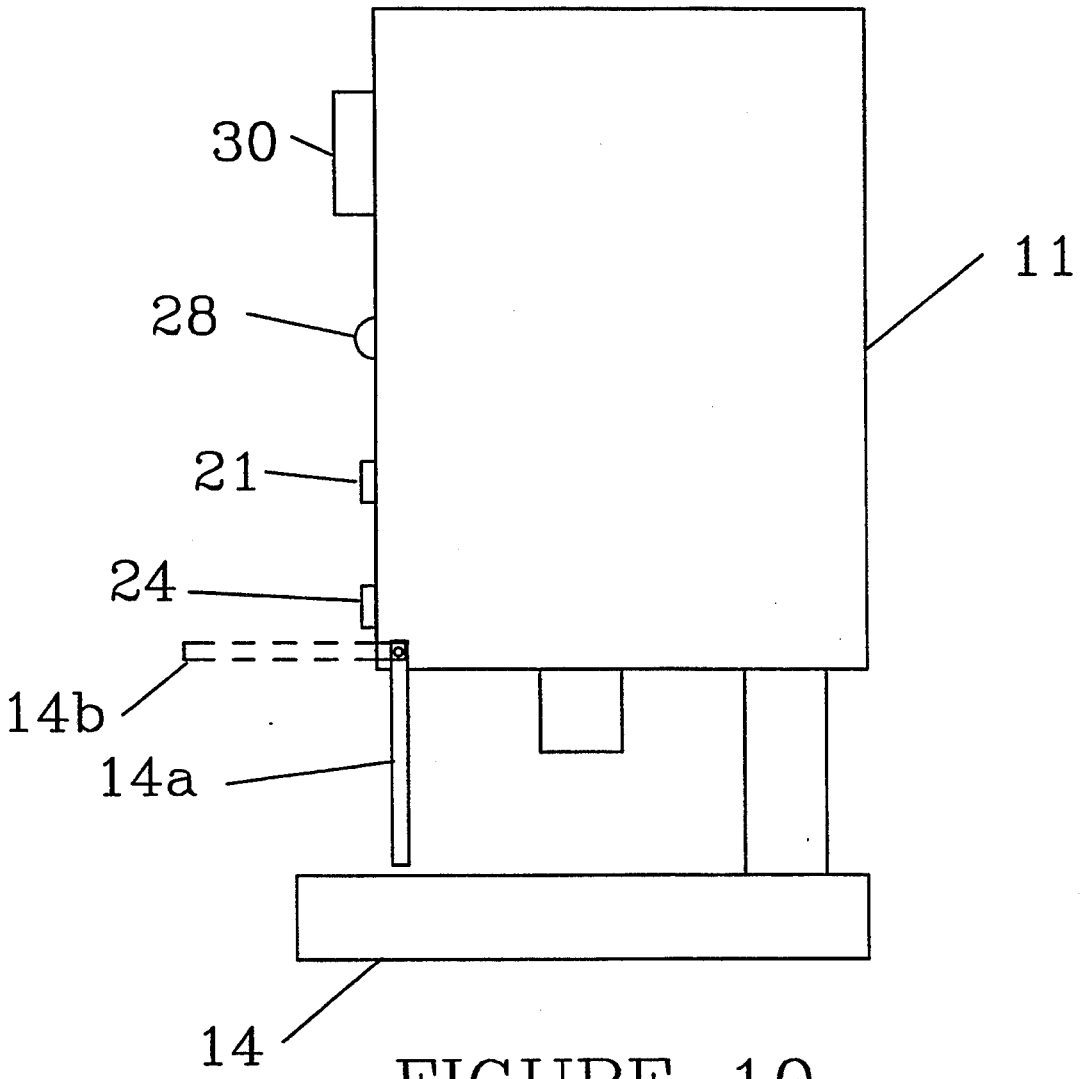
FIG. 10 is a side view of the apparatus shown the safety shield.

After lamination, the comb block and connector are moved to the pressing station where the connector top 38*b* (FIG. 9) is pressed onto the bottom portion 38 of the connector and the wires 66 (FIG. 9) are pressed into the contacts in the connector. Lacing bar 35 is moved from right to left until the comb block is in position under pressing station 18. Sensor 19 turns light 26 on when the comb block is correctly positioned. Light 25 indicates when the comb block is not correctly positioned. Sensor 19 operates similarly to sensor 20. When the comb block is positioned under pressing station 17, the operator places a connector top over the connector bottom part. A safety shield 14*a* (FIG. 10) is lowered to close a safety switch to prevent the operator from having a hand under the apparatus, then start button 22 is pressed to cause pressing station 17 to lower, engaging the top of the connector with pressing surface 18 to press the connector parts together and to press the conductor wire of the cable into electrical contact with the contacts of the connector. Safety shield 14*a* is shown in a raised position 14*b*. The safety shield may be connected to a lock out switch which prevents operation if the apparatus if the shield is up.

Pressing station 17 is lowered by air pressure as indicated by gauge 29. In the event of an emergency, emergency stop button 24 is pressed, and pressing station 15 or 17, the one that is in operation, will be immediately released.

The above procedure is done for each connector on the cable. Each connector position may be laminated and then the connector parts pressed together to connect the cable conductors to the connector contacts, or a connector position may be laminated and then immediate thereafter pressed, depending upon the desired sequence of operations.

What is claimed:

1. An apparatus for utilizing round cable with a plurality of conductors, and attaching ribbon cable connectors to portions of the conductors that have been arranged in a flat array of conductors, comprising a housing including at least one pressing station;

a platform under the housing and pressing station;

a lacing bar, including a plurality of comb blocks for holding a connector and for positioning conductors over contacts on said connector, movable on said platform for holding a cable, and connectors than are be attached to the cable; and a sensor on said platform for indicating when a connector is under said pressing station.

2. The apparatus according to claim 1, including at least one clamp to hold the cable in position on the lacing bar.

3. The apparatus according to claim 1, including a connector carrier for holding a connector in a comb block.

4. The apparatus according to claim 1, wherein said pressing station is used for laminating the plurality of conductors into a flat conductor array.

5. The apparatus according to claim 1, wherein said pressing station is actuated by an air cylinder.

6. An apparatus for utilizing round cable with a plurality of conductors, and attaching ribbon cable connectors to portions of the conductors that have been arranged in a flat array of conductors, comprising a housing including at least first and second pressing stations;

a platform under the housing and pressing stations;

a lacing bar, including a plurality of conch blocks for holding conductors, movable on said platform for holding a cable, and connectors that are be attached to the cable; and sensors on said platform for indicating when a connector is under a pressing station.

7. The apparatus according to claim 6, including at least one clamp to hold the cable in position on the lacing bar.

8. The apparatus according to claim 6, wherein said comb blocks are adjustable along the lacing bar for holding connectors at desired positions along the lacing bar.

9. The apparatus according to claim 6, including a connector carrier for holding a connector in a comb block.

10. The apparatus according to claim 6, wherein said first pressing station is used for laminating the plurality of conductors into a flat conductor array, and the second pressing station is used to press the each of the plurality of conductors into electrical contact with a contact on said connector.

11. The apparatus according to claim 6, wherein said pressing stations are actuated by air cylinders.

12. The apparatus according to claim 6, wherein said first pressing station includes a heating element to fuse lamination material to the conductors.

13. The apparatus according to claim 6, wherein said first pressing station includes two centering fingers for adjusting the comb block and connector therein precisely under the pressing station.

14. An apparatus for utilizing round cable with a plurality of conductors, and attaching ribbon cable connectors to portions of the conductors that have been arranged in a flat array of conductors, comprising an apparatus housing;

a first pressing station for laminating the flat array of conductors;

a second pressing station for electrically connecting the conductors to contacts on the connector;

a platform under the housing and pressing stations;

a lacing bar, including a plurality of comb blocks, including connector carriers for holding the cable and array of conductors, movable on said platform; and sensors on said platform for indicating when a comb block and connector is under a pressing station.

15. The apparatus according to claim 11, including an adjustable air solenoid for restricting air flow to the air cylinder to move the air cylinder slowly downward.

* * * * *